US010446949B2

(12) United States Patent
Ehret et al.

(10) Patent No.: US 10,446,949 B2
(45) **Date of Patent: *Oct. 15, 2019**

(54) COAXIAL CABLE CONNECTOR SLEEVE

(71) Applicant: PPC BROADBAND, INC., East Syracuse, NY (US)

(72) Inventors: Trevor Ehret, Syracuse, NY (US); Andrew Haberek, Baldwinsville, NY (US); Noah Montena, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/786,460

(22) Filed: Oct. 17, 2017

(65) Prior Publication Data

US 2018/0233836 A1 Aug. 16, 2018

Related U.S. Application Data

(63) Continuation of application No. 14/803,471, filed on Jul. 20, 2015, now Pat. No. 9,793,622, which is a continuation of application No. 14/018,916, filed on Sep. 5, 2013, now Pat. No. 9,124,046, which is a continuation of application No. 13/210,957, filed on Aug. 16, 2011, now Pat. No. 8,568,164, which is a continuation-in-part of application No. 12/636,367, filed on Dec. 11, 2009, now Pat. No. 7,997,930.

(51) Int. Cl.

| | |
|---|---|
| ***H01R 9/05*** | (2006.01) |
| ***H01R 13/622*** | (2006.01) |
| ***H01R 24/54*** | (2011.01) |
| ***H01R 43/26*** | (2006.01) |
| ***H01R 24/40*** | (2011.01) |
| *H01R 103/00* | (2006.01) |

(52) U.S. Cl.
CPC ..... *H01R 9/05* (2013.01); *H01R 13/622* (2013.01); *H01R 24/40* (2013.01); *H01R 24/54* (2013.01); *H01R 43/26* (2013.01); *H01R 2103/00* (2013.01)

(58) Field of Classification Search
CPC ..... H01R 13/622; H01R 2103/00; H01R 9/0521; F21S 6/002
USPC ..... 439/320, 322, 323, 578, 583, 584
See application file for complete search history.

(56) References Cited

U.S. PATENT DOCUMENTS

| | | | | |
|---|---|---|---|---|
| 1,971,500 A * | 8/1934 | Palmer | F16L 35/00 138/110 |
| 4,017,139 A | 4/1977 | Nelson | |
| 4,854,893 A | 8/1989 | Morris | |
| 4,990,104 A | 2/1991 | Schieferly | |
| 5,002,503 A | 3/1991 | Campbell et al. | |

(Continued)

FOREIGN PATENT DOCUMENTS

EP 0 624 933 B1 9/1998

OTHER PUBLICATIONS

Oct. 21, 2014 Office Action issued in Chinese Patent Application No. 201010610044.8.

(Continued)

*Primary Examiner* — Thanh Tam T Le
(74) *Attorney, Agent, or Firm* — Oliff PLC

(57) ABSTRACT

A sleeve for a coaxial cable connector has, in one embodiment, ends, an exterior surface, and an interior surface. The interior surface is configured to mate with a coupler of the coaxial cable connector.

20 Claims, 10 Drawing Sheets

(56) References Cited

U.S. PATENT DOCUMENTS 5,066,248 A 11/1991 Gaver, Jr. et al.
5,181,861 A 1/1993 Gaver, Jr. et al.
5,217,393 A 6/1993 Del Negro et al.
5,297,458 A 3/1994 Smith et al.
5,316,348 A * 5/1994 Franklin ..... F16L 35/00 138/110
5,316,494 A 5/1994 Flanagan et al.
5,435,745 A 7/1995 Booth
5,470,257 A 11/1995 Szegda
5,632,651 A 5/1997 Szegda
5,857,711 A * 1/1999 Comin-DuMong .... B25B 13/06 285/115
6,153,830 A 11/2000 Montena
D440,939 S 4/2001 Montena
D460,947 S 7/2002 Montena
6,425,782 B1 7/2002 Holland
D462,327 S 9/2002 Montena
6,817,272 B2 * 11/2004 Holland ..... H01R 43/26 439/304
6,848,920 B2 * 2/2005 Fox ..... H01R 13/6397 439/133
6,848,931 B2 2/2005 McMullen et al.
6,971,912 B2 12/2005 Montena et al.
7,086,897 B2 8/2006 Montena
7,097,500 B2 8/2006 Montena
7,147,509 B1 * 12/2006 Burris ..... H01R 9/0521 439/578
7,186,127 B2 3/2007 Montena
7,189,091 B1 3/2007 Montena
7,189,113 B2 3/2007 Sattele et al.
7,300,309 B2 11/2007 Montena
7,347,129 B1 * 3/2008 Youtsey ..... B25B 13/06 81/124.2
7,500,868 B2 3/2009 Holland et al.
7,513,788 B2 4/2009 Camelio
7,544,094 B1 * 6/2009 Paglia ..... H01R 9/0518 439/585
7,618,276 B2 11/2009 Paglia et al.
7,727,011 B2 6/2010 Montena et al.
7,753,705 B2 7/2010 Montena
7,794,275 B2 9/2010 Rodrigues
7,824,216 B2 11/2010 Purdy
7,828,595 B2 11/2010 Mathews
7,837,501 B2 * 11/2010 Youtsey ..... H01R 24/40 439/445
8,016,605 B2 9/2011 Montena et al.
8,029,316 B2 10/2011 Snyder et al.
8,038,471 B2 10/2011 Malak
8,065,940 B2 * 11/2011 Wilson ..... B25B 13/06 81/467
8,172,609 B2 5/2012 Hsia
9,793,622 B2 * 10/2017 Ehret ..... H01R 13/622
2004/0194585 A1 * 10/2004 Clark ..... B25B 13/06 81/124.2
2004/0231126 A1 * 11/2004 Louwagie ..... H01R 13/622 29/426.1
2011/0117774 A1 5/2011 Malloy et al.
2013/0143438 A1 6/2013 Wilson et al.

OTHER PUBLICATIONS

Apr. 4, 2011 Notice of Allowance issued in U.S. Appl. No. 12/636,367.
Jul. 29, 2011 Search Report issued in International Application No. PCT/US2010/059018.
PCT International, Inc. "Torque Sleeve All-In-One Connector and Tool PCT-TS", PCT International, Inc. Catalog, 2010-2012, p. 1.
PCT International, Inc. "Jumper Sleeve Easy to Use Connect Tool PCT-JS", PCT International, Inc. Catalog 2009-2014, pp. 1-2.
Oct. 6, 2016 Office Action Issued in U.S. Appl. No. 14/803,471.
Nov. 2, 2017 Office Action Issued in U.S. Appl. No. 15/786,460.

* cited by examiner

COAXIAL CABLE CONNECTOR SLEEVE

CROSS-REFERENCE TO RELATED APPLICATIONS

This application is a continuation of U.S. patent application Ser. No. 14/803,471, filed on Jul. 20, 2015, pending, which is a continuation of U.S. patent application Ser. No. 14/018,916, filed on Sep. 5, 2013, now U.S. Pat. No. 9,124,046, which is a continuation of U.S. patent application Ser. No. 13/210,957 filed on Aug. 16, 2011, now U.S. Pat. No. 8,568,164, which is a continuation-in-part application of U.S. patent application Ser. No. 12/636,367 filed on Dec. 11, 2009, now U.S. Pat. No. 7,997,930. The entire contents of these applications are hereby incorporated by reference.

TECHNICAL FIELD

This disclosure relates generally to coaxial cable connectors and, more specifically, to a compliant sleeve adapted to assist in tightening the threaded nut of a connector to a port or fitting.

BACKGROUND

In using electronic devices such as cable boxes and cable modems, it is sometimes desired to connect such devices to televisions, digital video disc playback devices, digital video recorders, personal computers, or other sources of electronic signals. Typically, a coaxial cable supplied by a cable service company penetrates a wall in the user's premises and is distributed to one or more locations within the home through the use of additional coaxial cable segments typically referred to as jumper cables. The jumper cable is terminated near the location of the television, cable box, cable modem or digital phone. Each end of a jumper has a coaxial cable connector installed thereon. A common interface for the coaxial cable connector is an internally threaded rotatable nut. The connector threads onto an externally threaded port on the cable box, cable modem, or other device. Other devices may be connected to the cable box or cable modem using similarly configured coaxial cable jumpers and connectors.

Conventional coaxial cable typically contains a centrally located electrical conductor surrounded by and spaced inwardly from an outer cylindrical braided conductor or sheath. The center and braid conductors are separated by a foil and an insulator core, with the braid being encased within a protective outer jacket.

A first end of a conventional coaxial cable typically includes an inner cylindrical post adapted to be inserted into a suitably prepared end of the cable between the foil and the outer braid conductor, an end portion of the latter having been exposed and folded back over the protective jacket. The center conductor, the insulator core, and the foil thus form a central core portion of the cable received axially in the inner post, whereas the outer braided conductor and protective jacket comprise an outer portion of the cable surrounding the inner post. The conventional coaxial cable end connector further includes a connector body and/or compression member designed to coact with the inner post to securely and sealingly clamp the outer portion of the cable therebetween. The clamping to the jumper cable may be carried out by crimping, swaging or radial compression of connector body or compression sleeve by use of special tools adapted to mate with these components.

The second end of the connector typically includes an internally threaded nut rotatably secured to the connector body. The nut may be secured to a corresponding threaded port on the cable box, television, or other electronic device. The nut may be tightened using an appropriately sized wrench. To establish a reliable connection between the connector and the port, the nut must be threadedly advanced until a flange on the end of the post contacts then end face of the port.

One drawback to this tightening approach is that often space is very limited in the back of the electronic device and there is inadequate room for a wrench. For example, the cable box or television may be located within an entertainment console and access to port on the equipment may be limited. Or, access to a television housed in an entertainment console may be limited because the television may be too large or heavy to be moved.

Another drawback is that the person making the connection may be unaware of the proper method of establishing a reliable connection. In some instances, particularly when a wrench is unavailable, the user may cease hand-tightening after one or two turns. Although such a loose connection may provide adequate video signal, data transmission may be severely hampered or break down completely. Data transmission problems may affect voice over internet protocol (VOIP), for example.

SUMMARY

In one embodiment, a torque sleeve is provided including a sleeve body configured to receive a coaxial cable connector. The sleeve body comprises an integral sleeve portion extending inwardly from the sleeve body and includes a plurality of tabs spaced apart by slots extending along an axis and configured to flex in a radial direction. The torque sleeve is configured to be axially moved from a first position, where a portion of the torque sleeve encircles a portion of the coaxial cable connector when the coaxial cable connector is in an assembled state. Further, the torque sleeve is configured to be axially moved from the first position to a second position, where the integral sleeve portion is configured to snap-fit over a shoulder portion of a component of the coaxial cable connector. When snapped over the shoulder portion, the integral sleeve portion is retained axially relative to the coaxial cable connector when the connector is in the assembled state. The described embodiment, the component of the connector is a rotatable coupler.

Furthermore, the torque sleeve is configured to facilitate rotation about a first portion of the connector when the torque sleeve engages a second portion of the coupler and is configured so that movement from the first to the second position comprises axial movement that occurs after the coaxial cable connector is in the assembled state.

In one embodiment, an adapter sleeve for a coaxial cable connector transmits torque to a nut member on the cable connector. The adapter sleeve includes a cylindrical body having a first end and a second end defining a bore along a longitudinal axis therethrough. The bore defines an interior surface. The interior surface has a torque transmission feature sized to slideably engage the nut member. The first end of the body has at least one radially inward defined retainer lip. The retainer lip is dimensioned and adapted to engage with a corresponding retaining structure on an external surface of the nut member.

In another embodiment, the torque transmission feature is the interior surface of the body having a hexagonal shape corresponding to the nut member.

In another embodiment, the retainer lip is a continuous ring, and the corresponding retaining structure on the external surface of the nut is a retaining groove.

In another embodiment, a method for positioning a coaxial cable connector on a port of an electrical device is provided. The connector includes a body and a nut member. The method comprises the steps of providing an adapter sleeve. The adapter sleeve includes a first end and a second end defining a bore along a longitudinal axis therethrough. The bore defines an interior surface. The interior surface has a torque transmission feature sized to slideably engage the nut member on the cable connector. The first end of the body has at least one radially inward defined retainer lip. The retainer lip is dimensioned and adapted to engage with a corresponding retaining structure on an external surface of the nut member. The method further includes the step of slideably engaging the adapter sleeve including the torque transmission feature over the cable connector in an axial direction, and engaging the retainer lip into the corresponding structure on the nut member to impede axial movement of the adapter sleeve relative to the nut member. The method further includes the step of positioning the cable connector and adapter sleeve to the port and turning the adapter sleeve to transmit torque to the nut member.

In another embodiment, adapter sleeve for a coaxial cable connector having a nut member including a retaining structure on an external surface of the nut member, said adapter sleeve comprising a cylindrical body comprising a first end and a second end defining a bore along a longitudinal axis therethrough, the bore defining an interior surface, the interior surface having a torque transmission feature sized to slideably engage the nut member on the coaxial cable connector, the cylindrical body having at least one recessed portion, wherein the recessed portion is dimensioned and adapted to mate with the retaining structure on the external surface of the nut member.

In another embodiment, coaxial cable connector comprising a connector body, a nut member, the nut member being independently rotatable with respect to the connector body and having a retaining structure on an external surface of the nut member, and an adapter sleeve comprising a cylindrical body comprising a first end and a second end defining a bore along a longitudinal axis therethrough, the bore defining an interior surface, the interior surface having a torque transmission feature sized to slideably engage the nut member on the coaxial cable connector, the first end of the body having at least one recessed portion, wherein the recessed portion of the cylindrical body is dimensioned and adapted to mate with the retaining structure on the external surface of the nut member to interfere with the removal of the adapter sleeve from the nut member.

In another embodiment, method for positioning a coaxial cable connector on a port of an electrical device, the connector comprising a body and a nut member including a retaining structure on an external surface of the nut member, the method comprising the steps of providing an adapter sleeve, the sleeve comprising a first end and a second end defining a bore along a longitudinal axis therethrough, the bore defining an interior surface, the interior surface having a torque transmission feature sized to slideably engage the nut member, the first end of the body having at least one recessed portion, wherein the recessed portion is dimensioned and adapted to engage with the retaining structure on the external surface of the nut member, slideably engaging the adapter sleeve including the torque transmission feature over the coaxial cable connector in an axial direction, mating the recessed portion with the retaining structure on the nut member to interfere with the removal of the adapter sleeve relative to the nut member, and turning the adapter sleeve to transmit torque to the nut member to axially advance the coaxial cable connector onto the port.

BRIEF DESCRIPTION OF THE FIGURES

For a further understanding of the invention, reference will be made to the following detailed description of the invention which is to be read in connection with the accompanying drawing, wherein.

DETAILED DESCRIPTION

Figure 1:
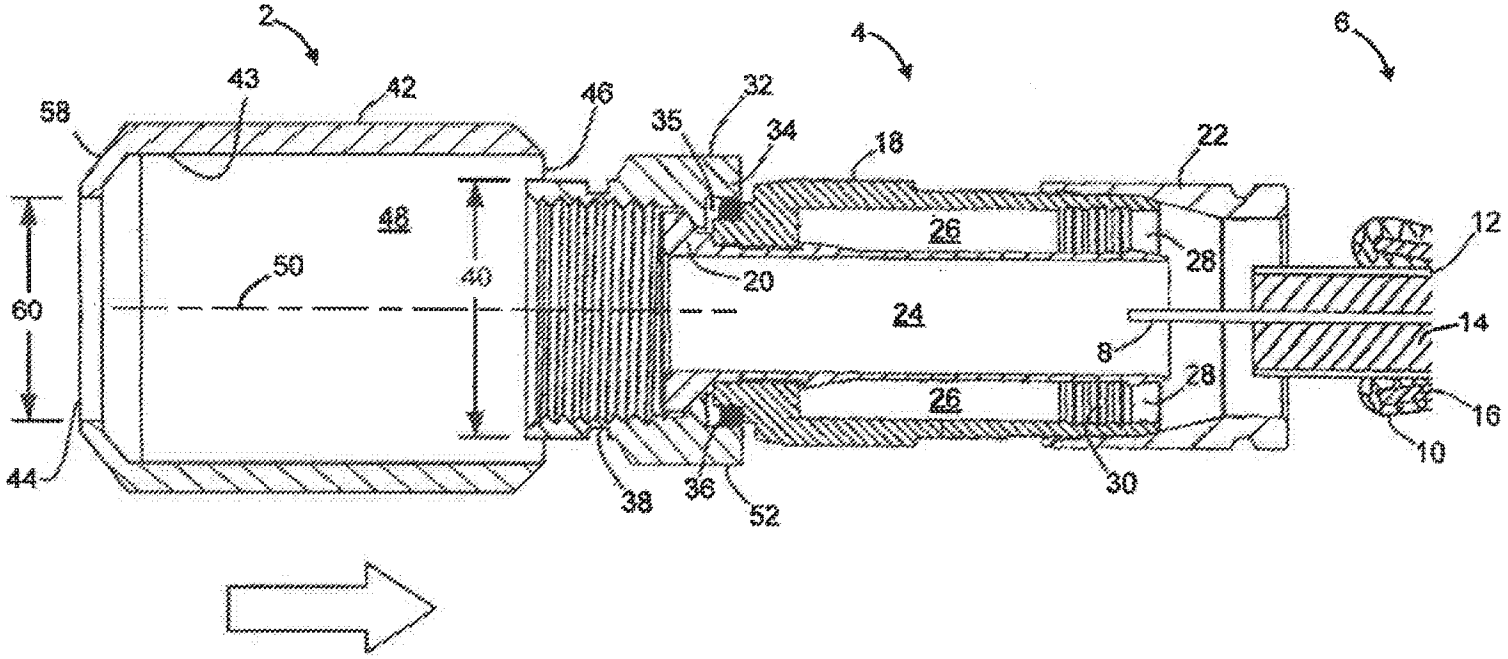
FIG. 1 is a longitudinal cross-sectional view prior to assembly of a first embodiment of an adapter sleeve, connector, and coaxial cable.

Referring to FIG. 1, an embodiment of an adapter sleeve 2 is shown adjacent to a conventional coaxial cable connector 4. The coaxial cable connector 4 is shown adjacent to the prepared end of a coaxial cable 6. In the example illustrated, coaxial cable 6 can be a known coaxial type having an electrical center conductor 8 surrounded by and spaced radially inwardly from a braid conductor 10 by a foil 12 and an insulator core 14. A protective outer jacket 16 surrounds the braided outer conductor 10 and comprises the outermost layer of the cable. Although an exemplary coaxial cable has been described, the illustrated coaxial cable connector 4 can also be used with coaxial cables having configurations different from that disclosed above, such as quad-shield cable that may include multiple layers of foil and braid.

An end of the cable is prepared, as shown in FIG. 1, to receive the connector 4 by selectively removing various layers to progressively expose an end of the center conductor 8 and an end of the insulator core 14 and foil 12 as illustrated. An end portion of the braided conductor 10 is folded over protective outer jacket 16.

A variety of coaxial cable connectors may be adapted for use with the adapter sleeve of the present invention, such as the connectors described in U.S. Pat. No. 5,470,257 to Szegda or U.S. Pat. No. 6,153,830 to Montena, which are incorporated by reference herein in their entirety. Referring to FIG. 1, the connector 4 is configured and dimensioned to accommodate receiving the prepared end of a coaxial cable. The connector 4 has a first body member that includes connector body 18 and post member 20. The connector 4 also has a second body member which as shown is fastener member 22. The post member 20 may be a tubular member defining a first inner cavity 24. The inner surface of connector body 18 is radially spaced about the post member 20 to define a first outer cavity 26 accessible via opening 28 at one end of the connector body 18. The first outer cavity 26 is closed at the other end of connector body 18 together with post member 20.

Typically, the connector body 18 and the post member 20 are separate components wherein the connector body 18 is press fitted onto the outer surface of the post member 20. In an alternative preferred embodiment, the connector body 18 and post member 20 can be formed integrally as a single piece. Also, the connector body 18 can be formed of a plastic composition.

The inner surface of the connector body 18 has annular serrations 30 disposed opposite the post member 20. The post member 20 and annular serrations 30 of the connector body 18 provide for a continuous environmental seal and grip on the braid conductor 10 and protective outer jacket 16 of the cable when the fastener member 22 is in its second configuration.

Figure 1A:
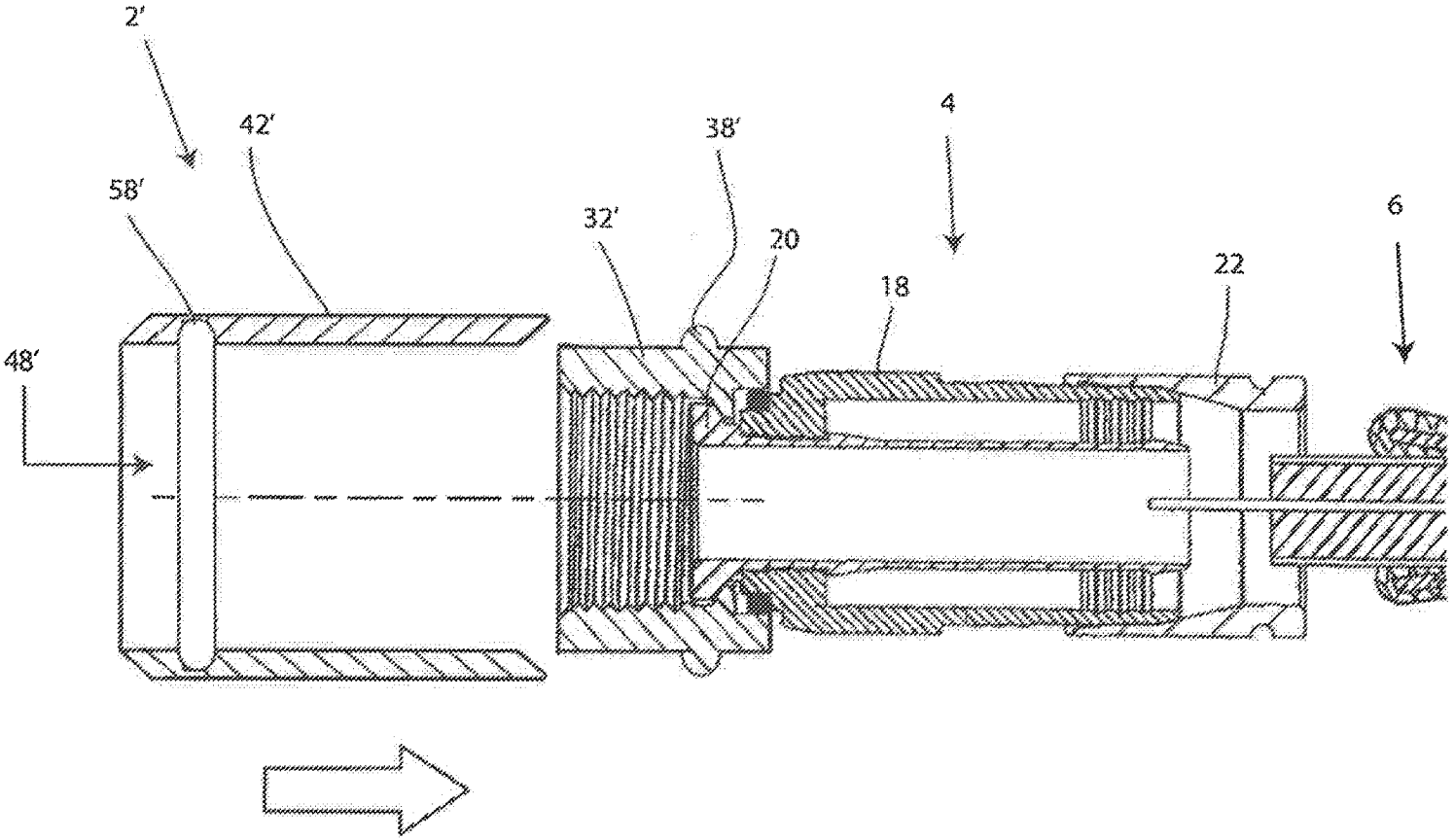
FIG. 1A is a longitudinal cross-sectional view prior to assembly of a second embodiment of an adapter sleeve, connector, and coaxial cable.

As illustrated in FIG. 1, a nut member 32 is internally threaded and is provided with a shoulder 34 seated in a groove 35 formed by the outer surface of the base of post 20 and the connector body 18. The nut member 32 and post 20 are independently rotatable. An O-ring seal 36 can be seated in groove 35 of connector body 18 to serve as a moisture barrier. The nut member 32 further includes a cylindrical retaining groove 38 in an aft outer diameter 40 to accept a portion of the adapter sleeve 2, as will be explained below. Alternatively, nut member 32' may include an retaining structure 38' to mate with a portion of the adapter sleeve 2', as shown in FIG. 1A.

The fastener member 22 is movably coupled to the connector body 18 so as to be capable of being moved on the connector body 18 from a first preassembled configuration to a second assembled configuration. In a pre-installed first configuration as illustrated in FIG. 1, the fastener member 22 is fastened onto the connector body 18 such that the initial diameter is securely attached to the outer diameter of the connector body 18. In this manner, the fastener member 22, in its pre-installed first configuration, is securely fastened to the connector body 18 and is thus in an assembled state during storage, handling, and installation on a cable end.

The second configuration is achieved after the fastener member 22 is moved axially along the connector body 18 to a second location on the connector body 18 such that the smaller inner diameter of the fastener member 22 engages the outer surface of the connector body 18.

A method of positioning the connector on a coaxial cable is now described. The end of a coaxial cable 10 is prepared by exposing a central core portion including the center conductor 8, insulator core 14, and foil 12. The outer braid conductor 10 is folded over the end of the outer protective outer jacket 16. The prepared end of the coaxial cable can be inserted through the second opening of fastener member 22 such that the central core portion including the center conductor 8, insulator core 14, and foil 12 is inserted into the first inner cavity 24 of post member 20. Also, the outer portion of the cable including outer braid conductor 10 folded over the end of the outer sheath jacket 16 is received into the first outer cavity 26 through opening 28.

Once the insulator core portion of the cable is positioned to abut the post member 20, the fastener member 22 is then advanced or moved axially from its pre-installed first configuration to its second configuration by a standard tool.

Since the smallest inner diameter of the fastener member 22 is smaller than the aft outer diameter of the connector body 18 accepting the fastener member 22, the connector body is concentrically gripped so that the volume of the first outer cavity 26 is further decreased. That is, the connector body 18 is further displaced or moved radially inwardly. As a result, the outer portion of the cable is firmly gripped or clamped between the outer surface of post member 20 and connector body 18. In this manner, the post member 20 cooperates with the annular serrations 30 of the connector body 18 to provide a generally continuous, 360 degree seal and grip on the outer portion of the cable.

The adapter sleeve 2 may be installed over the coaxial cable connector 4 once the fastener member 22 is in its second configuration. Alternatively, the adapter sleeve may be dimensioned and adapted so that the adapter sleeve may be placed over the connector before the fastener member 22 is axially advanced. After the adapter sleeve is placed over the connector, the nut member 32 may then be rotated to attach the connector to a system component—typically a threaded port or the like.

The adapter sleeve 2 includes a generally cylindrical body 42 having a first end 44 and a second end 46 defining a bore 48 along a longitudinal axis 50. Those having skill in the art should appreciate that the body 42 may have irregular inner and outer walls (e.g. in the angular direction), such as a thin-walled hexagonal axial extrusion. The external surface of the body of the adapter sleeve may be textured to assist a user in turning the adapter sleeve 2 by hand. The texture may be grooved, splined, or knurled for example. Alternatively, the external shape of the adapter body 42 may be a prism, elliptic cylindrical, or have flats or concavities to assist the user in grasping and manipulating the adapter.

Figure 2:
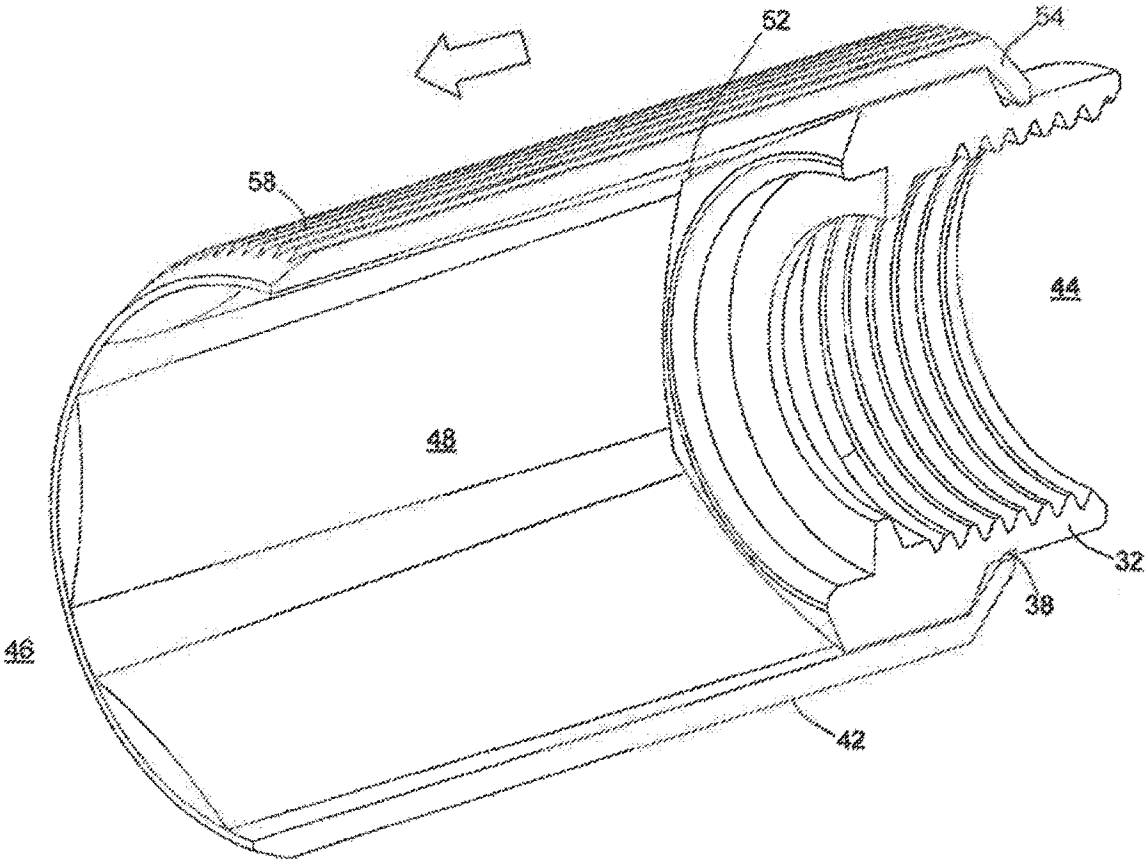
FIG. 2 is an isometric cutaway view of the first embodiment of the adapter sleeve and nut member of FIG. 1.

The bore 48 of the adapter sleeve body 42 defines an interior surface 43. The interior surface 43 includes a torque transmission feature in the first end 44 of the body 42. In one embodiment, the torque transmission feature defines a geometric shape to match the contour of the nut member 32. In the illustrated example and also as shown in FIG. 2, the torque transmission feature forms a hexagonal shape. The contour may be sized for a line-on-line fit with an outer contour 52 of the nut member 32. The compliant nature of the sleeve 2 allows it to be guided over the nut 32.

Figure 3A:
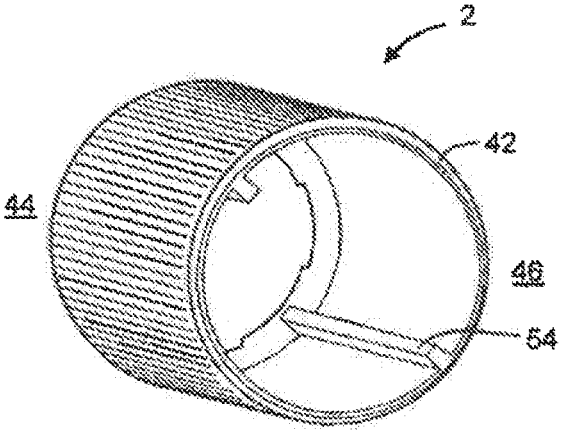
FIG. 3A is a perspective view of another embodiment of the adapter sleeve shown in FIG. 1.
Figure 3B:
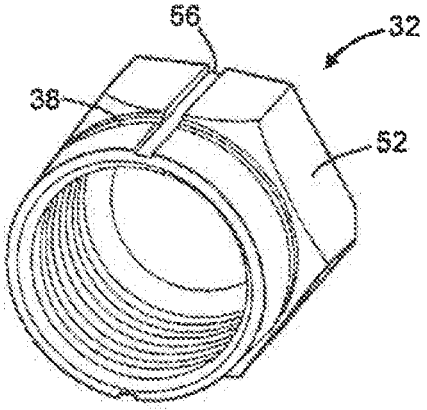
FIG. 3B is a perspective view of another embodiment of the nut member shown in FIG. 1.

Referring to FIG. 3A, in another embodiment the torque transmission feature comprises a keyway 54. The keyway 54 may have a rectangular shape as shown, or alternately may be gear shaped or elliptical. Referring to FIG. 3B, the nut member 32 includes a corresponding key slot 56 to accept the keyway 54.

Figure 4A:
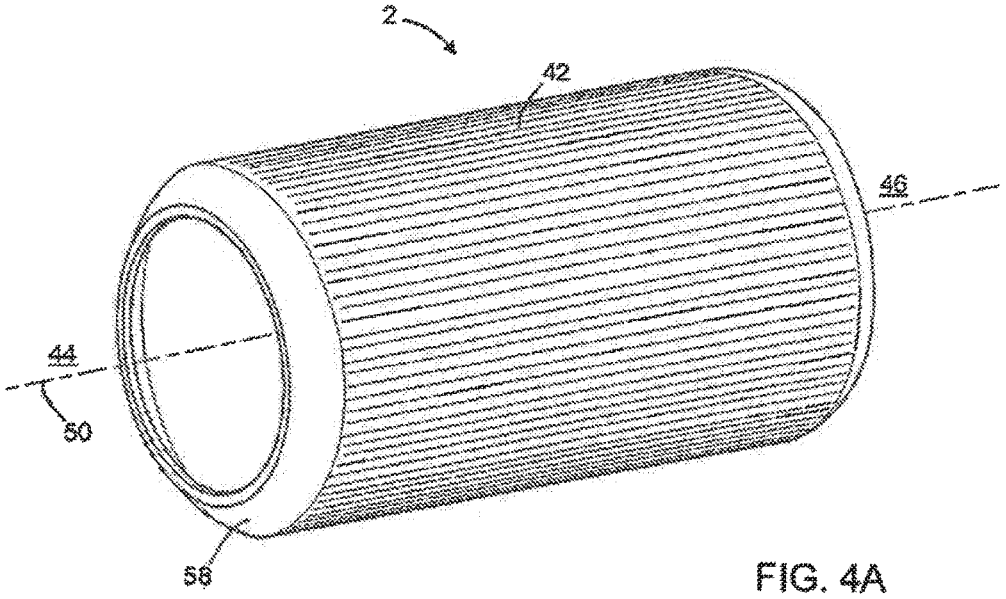
FIGS. 4A and 4B are perspective views of two embodiments of the retainer lip of the adapter shown in FIG. 1.

Referring to FIGS. 1 and 4A, the first end 44 of the body 42 further defines at least one retainer lip 58 having a radially inward orientation relative to the longitudinal axis 50. The retainer lip 58 is configured to engage a corresponding structure on an external surface of the nut member 32 to impede or prevent axial movement of the adapter sleeve 2 relative to the nut member 32. The retainer lip 58 and corresponding structure on the nut member 32 also serve to interfere with the removal of the sleeve 2. In one embodiment, the corresponding structure is the retaining groove 38. Thus, an inner diameter 60 of the retainer lip 58 is sized smaller than the outer diameter 40 of the nut member 32 but, due the flexibility of the sleeve material, the retainer lip 58 deflects until it engages the retaining groove 38. In one example, the inner diameter 60 is about 0.005-0.010 inches less than the outer diameter 40 of the nut member 32. In another example, a plurality of retainer lips 58 and retaining grooves 38 may be utilized to assure the adapter sleeve 2 will be difficult to remove.

Figure 4B:
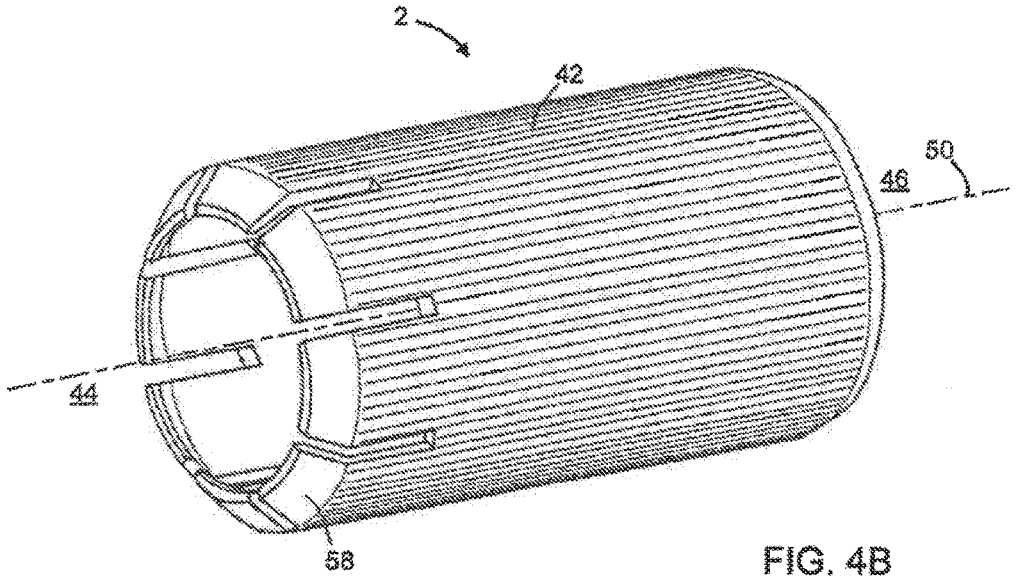

In another embodiment, the retainer lip 58 may be segmented to further provide greater flexibility. As illustrated in FIG. 4B, the retainer lip 58 may comprise one or more tabs. In another example, the segments may comprise teeth (not shown).

Figure 5:
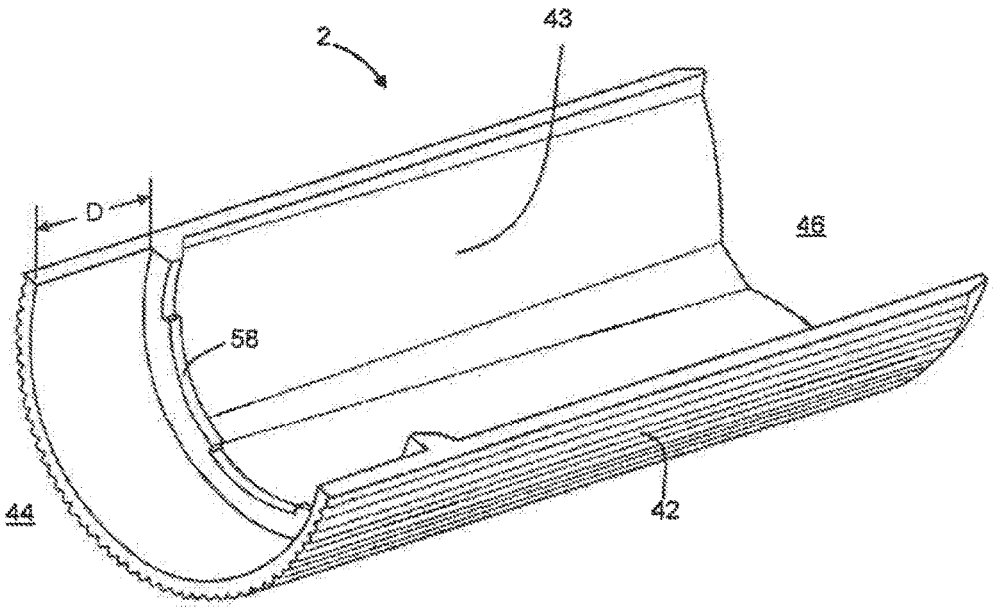
FIG. 5 is a cutaway perspective view of another embodiment of the retainer lip of the adapter shown in FIG. 1.
Figure 6A:
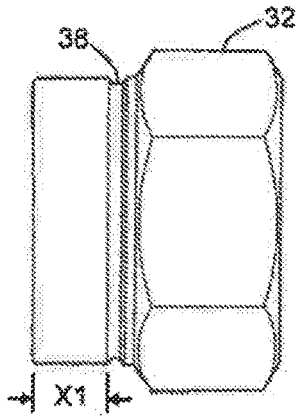
FIGS. 6A-6C are side views of three embodiments of the nut member shown in FIG. 1.
Figure 6B:
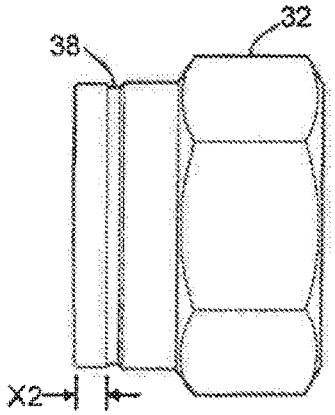
Figure 6C:
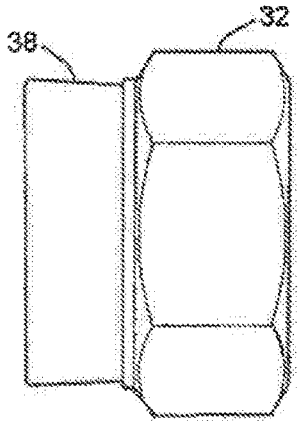

Referring to FIG. 5, in yet another embodiment the retainer lip 58 may be inwardly offset a distance "D" from the first end 44 of the body 42. In this manner and referring to FIGS. 6A and 6B, the corresponding retaining groove 38 in the nut member 32 may be positioned at any convenient axial location, for example X1 or X2. As shown in FIG. 6C, the retaining groove 38 may alternately assume a conical shape.

Figure 7:
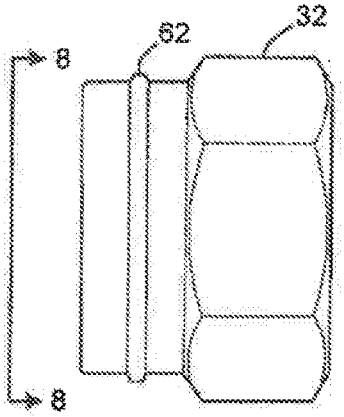
FIG. 7 is a side view of another embodiment of the nut member shown in FIG. 1.
Figure 8A:
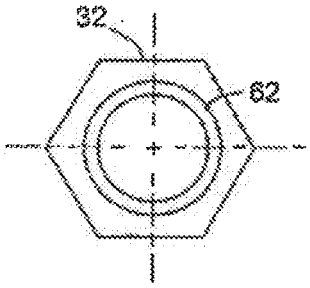
FIGS. 8A and 8B are end views of two embodiments of the nut member shown in FIG. 1.
Figure 8B:
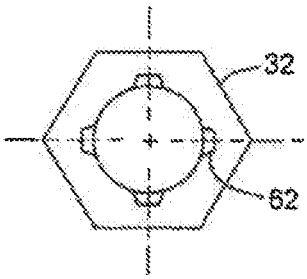

Referring now to FIGS. 1 and 7, the corresponding structure on the external surface of the nut member 32 may be a protrusion 62. The retainer lip 58 engages the protrusion 62 to prevent axial movement of the adapter sleeve 2 relative to the nut member 32, in much the same manner as the retaining groove 38 in the example given above. Referring to FIGS. 8A and 8B, the protrusion 62 may include continuous or discontinuous structures such as annular radial protrusions, one or more arcuate protrusions, tabs, or detents on the exterior surface of the nut member.

The adapter sleeve 2 may be formed of a polyacetal engineered plastic such as Delrin®, manufactured by E. I. du Pont de Nemours and Company. In another embodiment, the sleeve 2 may be made of a pliable metal such copper.

Figure 9:
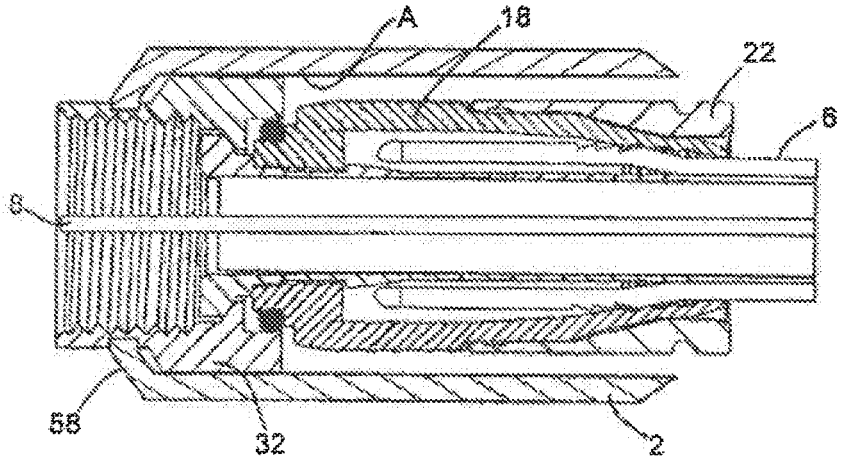
FIG. 9 is a longitudinal cross-sectional view after assembly of the adapter sleeve, connector, and coaxial cable of FIG. 1.

In operation, the coaxial cable connector 4 may first be assembled to the coaxial cable 6 as described above. Next, the second end 46 of the adapter sleeve 2 may be aligned to the nut member 32 of the connector and pushed in the axial direction along the longitudinal axis 50 (e.g., in the direction of the arrow), over the nut, until the retainer lip 58 on the first end 44 of the sleeve engages corresponding structure on the nut member 32, which is the retaining groove 38 in the illustrated example. The cable assembly is then ready to be installed on the system component port such as a cable box. The completed assembly is illustrated in FIG. 9.

In another example, the adapter sleeve 2 may first be engaged over the coaxial cable connector 4 prior to installing the connector to the coaxial cable 6. This feature allows packaging the adapter sleeve 2 pre-assembled to the connector 4. This method may be adapted to a variety of coaxial cable connectors, as long as the installation tool does not interfere with adapter sleeve 2.

Because the interior surface 43 in the first end 44 of the body 42 defines a geometric shape matching the contour of the nut member 32, the adapter sleeve 2 effects torque transmission to the nut member 32. Thus, the nut may be hand-tightened without the use of a wrench. The outer contour of the cylindrical body 42 may include grooves 64, knurls, ribs, or other features to prevent slippage during the tightening or loosening operations. In one embodiment, the only radial contact surface between the adapter sleeve 2 and the coaxial cable connector 4 is at the nut member 32 interface. In the disclosed embodiment, the radial contact is limited to the hexagonal flats. As can be appreciated with reference to FIGS. 1 and 9, adequate clearance may be designed between the sleeve 2 and the connector body 18, and the sleeve 2 and the fastener member 22, so as to allow the nut member 32 to rotate freely without creating drag on other components of the connector 4. Furthermore, the retainer lip 58 may be designed to contact the retaining groove 38 only along side edges of the groove.

Figure 2A:
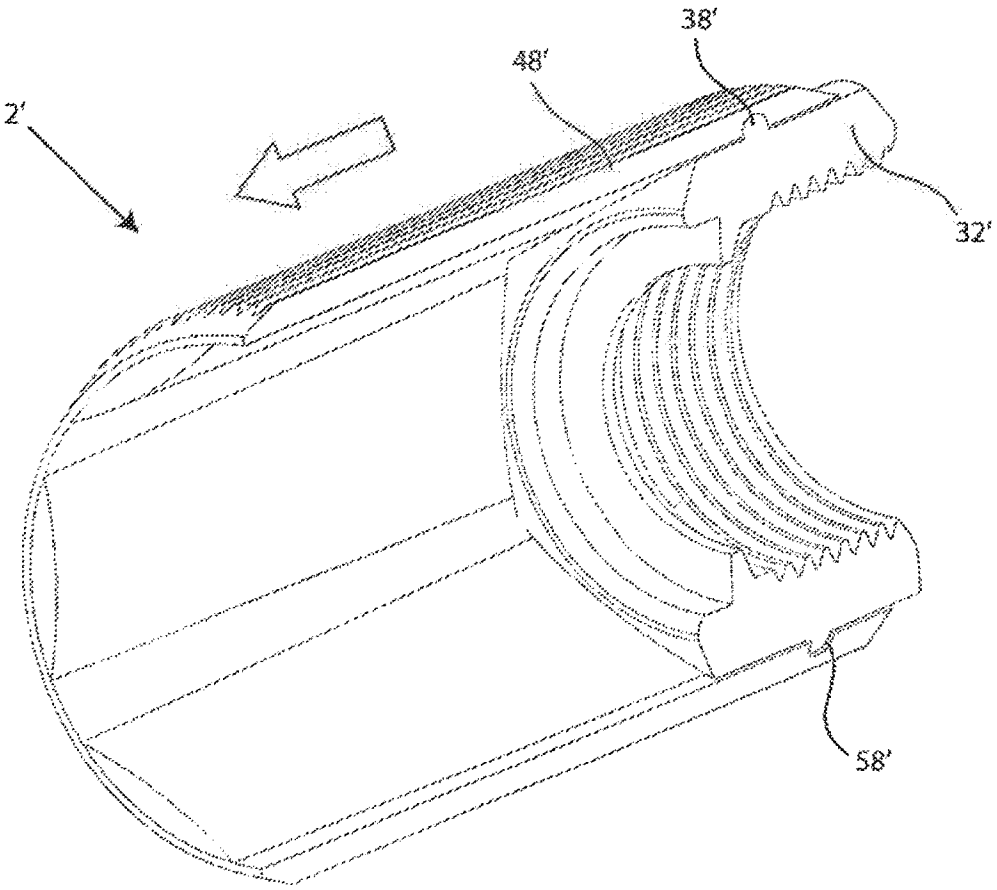
FIG. 2A is an isometric cutaway view of the second embodiment of the adapter sleeve and nut member of FIG. 1A.

With reference now to FIGS. 1A and 2A, an embodiment of adapter sleeve 2' may include a recessed portion 58', which may be configured to accommodate and/or mate with the retaining structure 38' of the nut member 32'. Specifically, embodiments of adapter sleeve 2' for a coaxial cable connector having a nut member 32' including a retaining structure 38' on an external surface of the nut member 32', said adapter sleeve 2' comprising a cylindrical body 42' comprising a first end and a second end defining a bore 48' along a longitudinal axis therethrough, the bore 48' defining an interior surface, the interior surface having a torque transmission feature sized to slideably engage the nut member 32' on the coaxial cable connector, the cylindrical body 42' having at least one recessed portion 58', wherein the recessed portion 58' is dimensioned and adapted to mate with the retaining structure 38' on the external surface of the nut member 32'. Embodiments of the recessed portion 58' of the adapter sleeve 2' may be an annular groove configured to mate with an annular or semi-annular protrusion on the surface of the nut member 32'. Other embodiments of the recessed portion 58' of the adapter sleeve 2' may be one or more detents configured to receive one or more bumps on the surface of the nut member 32'.

The corresponding structure on the external surface of the nut member 32' may be a retaining structure 38'. Embodiments of the retaining structure 38' may be an annular or semi-annular protrusion extending around or partially around the nut member 32', sized and dimensioned to fit within or substantially within the recessed portion 58' of the adapter sleeve 2'. Further embodiments of the recessed portion 38' may be one or more bumps located on the external surface of the nut member 32', configured to mate with and/or enter one or more detents on the interior surface of the adapter sleeve 2'.

Accordingly, engagement between the recessed portion 58' of the adapter sleeve 2' and the retaining structure 38' of the nut member 32' may be achieved by sliding the adapter sleeve 2' in the direction of the arrow shown in FIG. 1A, until the retaining structure 38' snaps into the recessed portion 58' of the adapter sleeve 2'. However, those skilled in the requisite art should appreciate that the adapter sleeve 2' may be slid over the nut member 32' in the opposite direction to snap into place. The end of the adapter sleeve 2' may be ramped to facilitate slidable engagement between the sleeve 2' and the nut member 32', in particular, with the retaining structure 38'. While the adapter sleeve 2' is operably attached to the nut member 32', the engagement between the recessed portion 58' and the retaining structure 38' may interfere with the removal of the adapter sleeve 2' from the nut member 32'. Unless otherwise provided, the function and structure of the adapter sleeve 2' and the nut member 32' may comprise the same or substantially the same structure and function as the adapter sleeve 2 and the nut member 32.

One advantage of the present invention is that a coaxial cable connector and jumper cable may be installed onto a corresponding electronic device without having to resort to the use of a wrench. This is particularly desirable when access to the electronic device is limited, or the device is housed in an enclosed space that is restricted. Further, a more secure and reliable connection may be established by use of hand-tightening. Without the adapter sleeve of the present invention, tightening the nut member on the port may be difficult, resulting in only a few threads being engaged. In contrast, using the adapter sleeve, greater torque transmission may be realized, resulting in a tighter, more secure connection.

One of the improvements of the present disclosure is that the sleeve remains fixedly engaged to the coaxial cable connector in the axial direction. That is, once the retaining rib snaps into the corresponding groove, the sleeve cannot easily be removed from the connector. This feature is particularly advantageous for pre-installed kits. For example, a broadband data provider may choose to provide customers with installation kits and instructions so the customer can connect a cable modem, for example, to an existing coaxial network. Inclusion of coaxial connectors with pre-installed adapter sleeves of the present invention will greatly increase the likelihood that the customer will correctly connect the connector to the port. This, in turn, saves the broadband data provider a service call to the premises in the event the installation was performed improperly.

In contrast, other sleeve designs having raised surfaces (e.g., hemispherical bumps or the like) on the internal contour of the bore tend to slip during tightening operations. Also, the raised surfaces, being quite small in overall surface area, tend to wear away with only a few installation and removal operations. Once worn away, the sleeve becomes free to move in the axial direction and hampers tightening operations.

Another improvement of the disclosed adapter sleeve is that it is easier to manufacture. In one example, the adapter sleeve is formed in a molding process such as injection molding. Prior art sleeve adapters included one or more hemispherical protrusions on one of the hexagonal interior surfaces, approximately at location "A" in FIG. 2. The protrusions were positioned such that they would flatten out as the sleeve moved over the nut member, and upon clearing the nut would pop out to the original shape in order to retain the sleeve in the axial direction. One problem with this approach was that the hemispherical protrusion represented an undercut in the mold die. Thus, for the same reason the protrusion acted as an effective axial retainer with the nut, it was also difficult to eject from the mold die. Hence, the protrusion was often damaged during the ejection phase of the mold process. In contrast, the retainer lip of the present invention presents no such problems during the molding process because the lip is formed where the mold die halves come together. Thus, the retainer lip never has to pass over any part of the mold in order to be ejected.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

The following is claimed:

1. A torque sleeve comprising:

a sleeve body configured to extend along an axis, the sleeve body further configured to at least partially receive a coaxial cable connector, the sleeve body comprising an integral sleeve portion extending inward from the sleeve body;

wherein the torque sleeve is configured to be axially moved from a first position, where a portion of the torque sleeve encircles a portion of the coaxial cable connector, to a second position, where the integral sleeve portion is configured to snap-fit over a shoulder portion of a rotatable coupler of the coaxial cable connector so as to retain an axial position of the torque sleeve relative to the coaxial cable connector; and wherein the torque sleeve is configured to facilitate rotation of the rotatable coupler about a portion of the connector when the torque sleeve engages the rotatable coupler; and wherein the torque sleeve is configured such that movement from the first to the second position comprises axial movement that occurs after the coaxial cable connector is in an assembled state.

2. The torque sleeve of claim 1, wherein the integral sleeve portion comprises a protrusion.

3. The torque sleeve of claim 1, wherein the shoulder portion defines a cavity.

4. The torque sleeve of claim 1, wherein the shoulder portion comprises a continuous protrusion.

5. The torque sleeve of claim 1, wherein the shoulder portion comprises a plurality of segmented protrusions.

6. The torque sleeve of claim 1, wherein the shoulder portion comprises a conical shape.

7. The torque sleeve of claim 1, wherein the shoulder portion defines a conical shaped retaining groove.

8. The torque sleeve of claim 1, wherein the integral sleeve portion comprises a protrusion, the rotatable coupler having an exterior surface, the exterior surface of the rotatable coupler defining a cavity configured to receive the protrusion.

9. The torque sleeve of claim 1, wherein the integral sleeve portion is a forward end portion of the torque sleeve, the forward end portion configured to face in a forward direction when the torque sleeve is attached to the coaxial cable connector.

10. The torque sleeve of claim 1, wherein the torque sleeve is configured so that movement from the first to the second position comprises axial movement that occurs before the integral sleeve portion is configured to snap-fit to the component of the coaxial cable connector.

11. The torque sleeve of claim 1, wherein the coaxial cable connector comprises a connector body and a post, and wherein, when the coaxial cable connector is in the assembled state, the connector body engages a portion of a cable, a portion of the connector body encircles a portion of the post, and the rotatable coupler is at least partially coupled to the post.

12. The torque sleeve of claim 1, wherein the torque sleeve is configured to fit around the coaxial cable connector and facilitate tightening of the coaxial cable connector when the torque force is applied to the torque sleeve and when the integral sleeve portion is in the first and second positions.

13. The torque sleeve of claim 1, wherein the integral sleeve portion comprises a plurality of tabs configured to flex, the tabs being spaced apart from each other by slots extending along the axis.

14. A torque sleeve comprising:

a sleeve body configured to extend along an axis, the sleeve body further configured to at least partially receive a coaxial cable connector, the sleeve body comprising a sleeve portion extending inward from the sleeve body;

wherein the torque sleeve is configured to be axially moved from a first position to a second position, where the sleeve portion is configured to snap-fit over a shoulder portion of a component of the coaxial cable connector; and wherein the torque sleeve is configured to facilitate rotation of the component about a first portion of the connector when the torque sleeve engages the component; and wherein the torque sleeve is configured such that movement from the first to the second position comprises axial movement that occurs after the coaxial cable connector is in an assembled state.

15. The torque sleeve of claim 14, wherein the component comprises a rotatable coupler of the coaxial cable connector.

16. The torque sleeve of claim 15, wherein the sleeve portion comprises a protrusion, the rotatable coupler having an exterior surface, the exterior surface of the rotatable coupler defining a cavity configured to receive the protrusion.

17. The torque sleeve of claim 14, wherein the sleeve portion is a forward end portion of the torque sleeve, the forward end portion configured to face in a forward direction when the torque sleeve is attached to the coaxial cable connector.

18. The torque sleeve of claim 14, wherein the torque sleeve is configured so that movement from the first to the second position comprises axial movement that occurs before the sleeve portion is configured to snap-fit to the component of the coaxial cable connector.

19. The torque sleeve of claim 15, wherein the coaxial cable connector comprises a connector body and a post, and wherein, when the coaxial cable connector is in the assembled state, the connector body engages a portion of a cable, a portion of the connector body encircles a portion of the post, and the rotatable coupler is at least partially coupled to the post.

20. The torque sleeve of claim 14, wherein the sleeve portion comprises a plurality of tabs configured to flex, the tabs being spaced apart from each other by slots extending along the axis.

* * * * *